US006101908A

United States Patent [19]

Azkona

[11] Patent Number: 6,101,908

[45] Date of Patent: Aug. 15, 2000

[54] SELF-ADJUSTING PLIERS

[75] Inventor: Manuel Azkona, Abadiano, Spain

[73] Assignee: Super-Ego Tools, S.A., Spain

[21] Appl. No.: 09/338,189

[22] Filed: Jun. 22, 1999

[51] Int. Cl.[7] ..... B25B 7/04

[52] U.S. Cl. ..... 81/385; 81/358; 81/413

[58] Field of Search ..... 81/385, 357, 358, 81/325, 409, 416, 405, 407, 341, 314, 393, 411, 413

[56] References Cited

U.S. PATENT DOCUMENTS

| | | | |
|---|---|---|---|
| 4,651,598 | 3/1987 | Warheit . | |
| 4,662,252 | 5/1987 | Warheit . | |
| 4,922,770 | 5/1990 | Dlugolecki et al. . | |
| 5,020,399 | 6/1991 | Annis et al. . | |
| 5,660,089 | 8/1997 | Chow | 81/413 |
| 5,887,495 | 3/1999 | Kao | 81/358 |

*Primary Examiner*—James G. Smith
*Assistant Examiner*—Hadi Shakeri
*Attorney, Agent, or Firm*—Bierman, Muserlian and Lucas

[57] ABSTRACT

Self-adjusting pliers, consisting of a male handle member and a female handle member with toothed jaws, sliding against each other by means of a pawl which connects them and slides in an elongated racked slot inserted in one of the toothed jaws, both handle members being joined together by a coupling link consisting of two sleeves (1), (2) which move against each other telescopically, one of them (2) pivoting on the male handle member (6) and the other on the female handle member (11); one spring (3) connecting both sleeves (1), (2) and a second spring (5) connecting one (1) of the sleeves with one (11) of the handle members.

Suitable for application in the manufacture of hand tools.

3 Claims, 2 Drawing Sheets

SELF-ADJUSTING PLIERS

Known pliers consist of two handle members with toothed jaws which slide against each other by means of a pawl which links them and which slides within an elongated slot set on one of the toothed jaws.

In the search for improved adaptation of the jaws to the workpiece and optimum grip, a pair of pliers was developed, for example, under U.S. Pat. Nos. 4,651,598; 4,662,252; 4,922,770; and 5,020,399 in which the handle members where subsequently joined together by a coupling link, which under pressure, slides one of its ends along one of the handle members and enables the pawl axis to be transferred.

The sliding of the end of the coupling link requires the handle member(s) to be equipped with a groove, runners, guides and orifices for the said sliding process, and the placing of the corresponding activating springs on the coupling link.

The need for these grooves in the handle members meant that, for ease of manufacture, the handle members needed to be made using sandwich-type overlying steel plates, but this solution provided pliers with low mechanical resistance and durability. The next step was to manufacture the handle arms with forged steel, but, by keeping the grooves, there were machining and cost problems.

It was also observed that the distance travelled by the ends of the handle members until they exerted real pressure on the workpiece was excessive.

The applicant has resolved all these problems with a solution that is both simple and surprising: the pliers will be made of forged steel, but the coupling link of the handle members does not slide, and thus the above-mentioned drawbacks are automatically overcome.

Specifically, the invention develops pliers in which the coupling link consists of:

a) two sleeves which move one against the other telescopically, one of them pivoting on the male handle member and the other on the female handle member;

b) one spring connecting both sleeves;

c) a second spring connecting one of the sleeves with one of the handle members.

For a better understanding of the object of this invention, the drawings show a preferred embodiment thereof, which is susceptible to contingency changes which would not sacrifice its basis.

Figure 1:
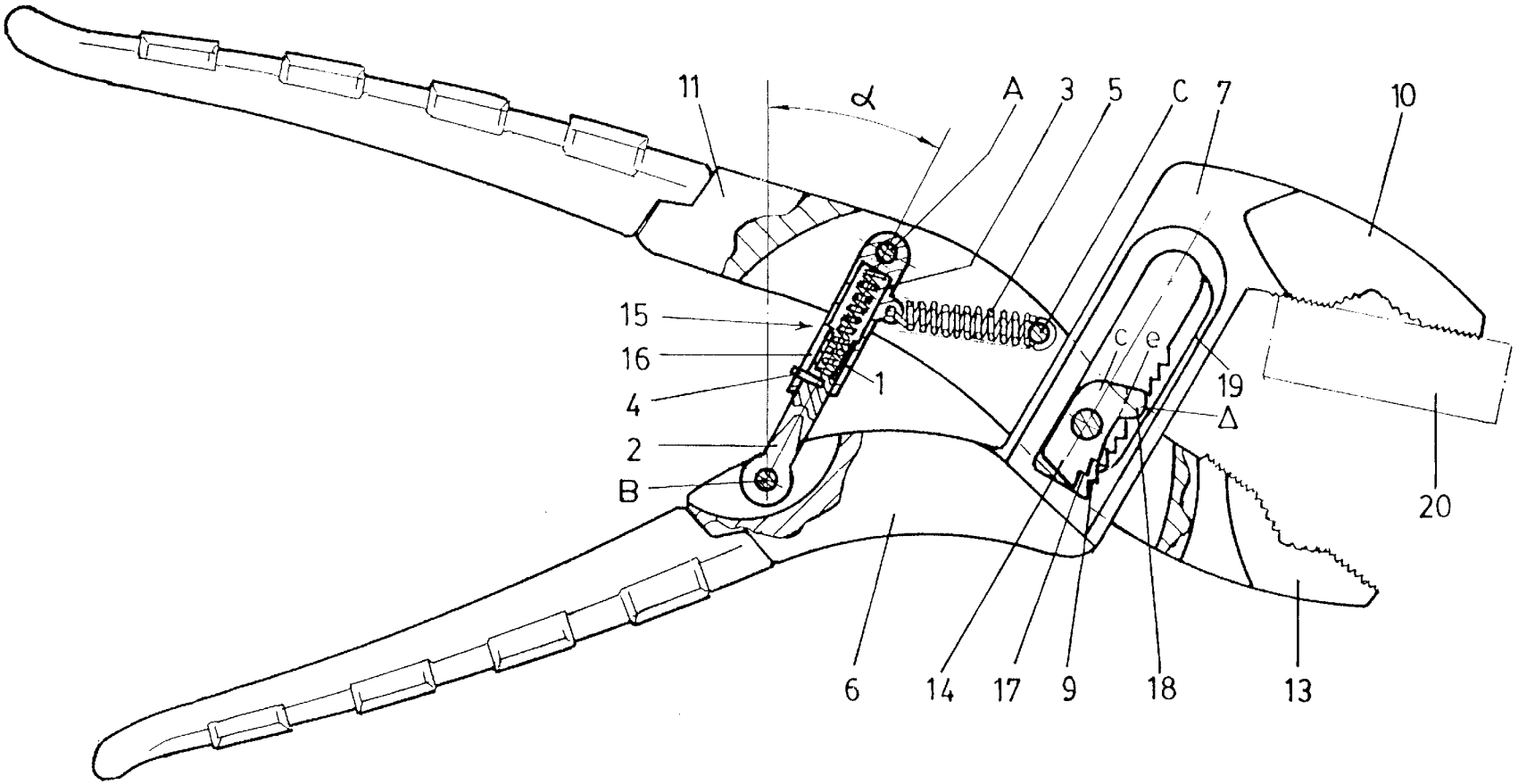
FIG. 1 is a partial cross-section view of a practical embodiment of the pliers of this invention, with the jaws open.

There now follows an example of a practical embodiment, which is not restrictive, of the present invention.

The pliers consist of a known male handle member (6) with a neck portion (7) with an upper toothed jaw (10) into which an elongated slot (8) with a rack (9) has been incorporated, and a female handle member (11) with wide opening (12), which enables the run of the male handle member's (6) neck (7), and which incorporates the lower toothed jaw (13) and a racked pawl (14) which pivots on an axis (21) and connects with the rack (9) of the elongated slot (8).

As a fundamental object of the invention, the male handle member (6) and the female handle member (11) are joined together by a coupling link (15) which pivots at each end on the male (6) and female (11) handle members.

The coupling link (15) consists of two elements which move against each other. In this embodiment it can be seen that the coupling link (15) consists of a female sleeve (1) which pivots on a pin (A) on the female handle member (11) and which serves as external guide for a male sleeve (2) which slides inside and pivots on the male handle member (6) by means of the pin (B). Both sleeves (1), (2) are joined by a spring (3).

The inner sleeve (2) is provided with a locking pin (4) guided in a groove (16) in the outer sleeve (1), although they can be disposed the other way round, or the device may be provided with any other conventional means of restricted travel between the two sleeves (1), (2).

At least one of the two sleeves (1), (2) is springed, in this case a spring (5) joined to the outer sleeve (1) and the female handle member (11) in a pivoting fashion (C), preferably with the pivot axis (C) situated between the pivoting pin (A) of the outer sleeve (1) and the pivoting axis (21) of the pawl (14).

Further problems affecting known pliers originate in the pawl (14), in that:

a) when it moves in the elongated slot (8) it slides on the rack (9) of the said slot (8), b) engagement of its teeth (17) with the rack (9) of the elongated slot (8) only occurs when the end (e) of its head (c) makes contact with the rack (9), which enables the approach of the axis (21) of the pawl (14) and the consequent engagement of the teeth (17) of the pawl with the rack (9) of the elongated slot (8).

In this invention the elongated slot (8) has been provided with a sliding track (19) next to the rack (9) in which a toe (18) projecting from the head (c) of the pawl (14) makes a sliding trajectory, so that the pawl (14) no longer makes contact in its travel with the rack (9) and the pivoting of the pawl (14) on its axis (21) is as small as is wanted, since it will be governed by the separation ($\Delta$) of the toe (18) with respect to the sliding track (19), which thus provides a much quicker grip and without any wear on the pawl (14).

Figures 2, 3:
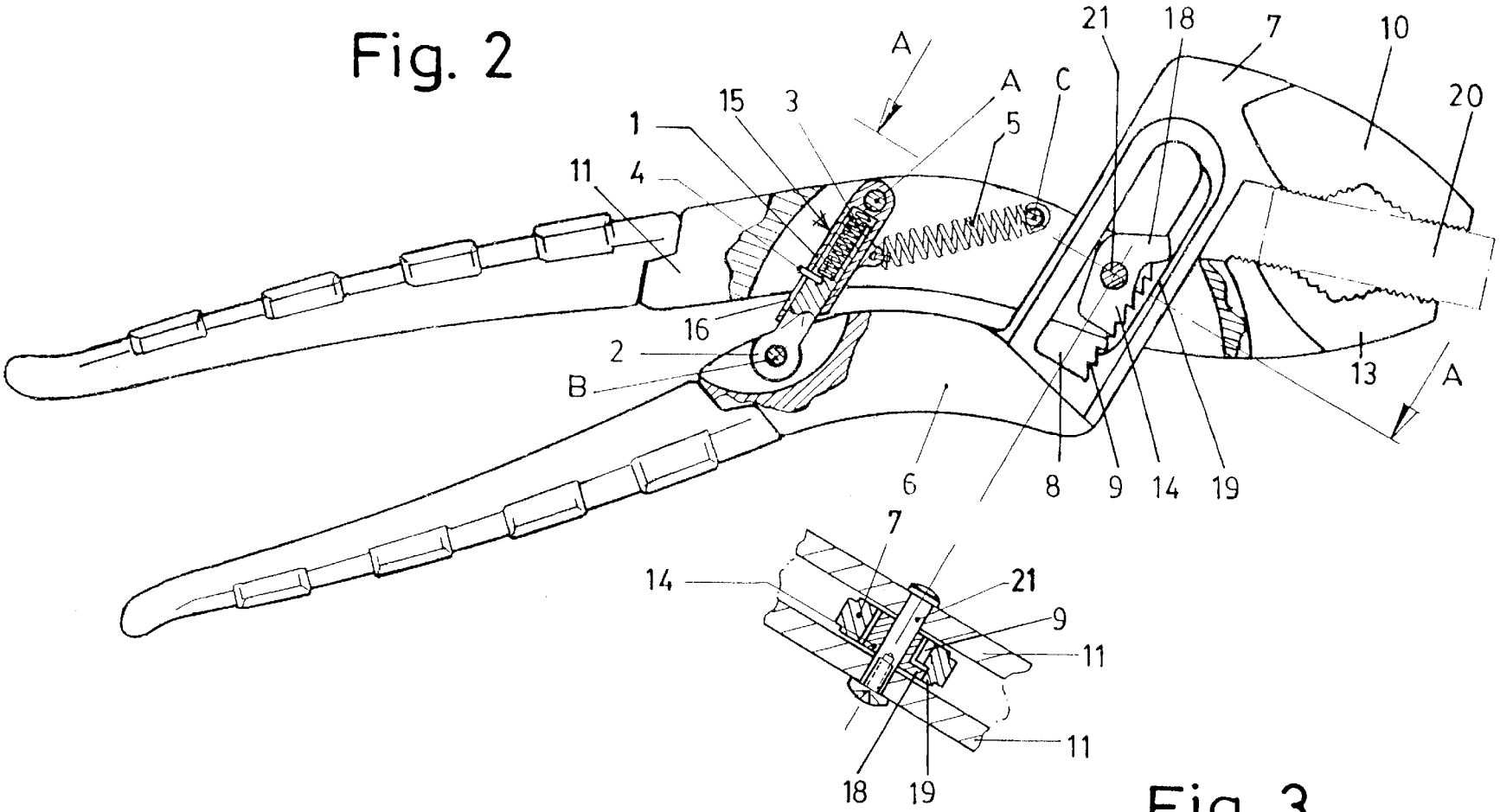
FIG. 2 is a partial cross-section view of a practical embodiment of the pliers of this invention, with the jaws closed.
FIG. 3 is a partial view taken along the line A:A in FIG. 2.

This, together with the fact that the pivoting of the coupling link (15) from its rest position ($\alpha$) or of the open pliers (FIG. 1) to their closed position (FIG. 2), is very small (some 40), means that manual action (f) on the handle members for gripping the workpiece 20 involves much less travel than for known examples up to now.

What is claimed is:

1. Self-adjusting pliers, having a male handle member and a female handle member with toothed jaws, sliding against each other by means of a pawl which connects them and slides in an elongated racked slot inserted in one of the toothed jaws, both handle members being joined together by a coupling link, characterised in that it comprises:

a) two sleeves (1), (2) which move against each other telescopically, one of them (2) pivoting on the male handle member (6) and the other on the female handle member (11);

b) one spring (3) connecting both sleeves and;

c) a second spring (5) connecting one (1) of the sleeves with one (11) of the handle members.

2. Self-adjusting pliers, according to claim 1, further comprising a travel restricting device (4) between both sleeves (1), (2).

3. Self-adjusting pliers, according to claim 1, characterised in that the pawl has a head, the elongated slot (8) has been provided with a sliding track (19) on its longitudinal wall for a toe (18) projecting from the head (c) of the pawl (14), with the result that when the pliers are in the open position, there is a predetermined compensation (A) between the said toe (18) and the said sliding track (19).

* * * * *

UNITED STATES PATENT AND TRADEMARK OFFICE

CERTIFICATE OF CORRECTION

PATENT NO. : 6,101,908
DATED : August 15, 2000
INVENTOR(S) : M. Azkona

It is certified that error appears in the above-identified patent and that said Letters Patent is hereby corrected as shown below:

Column 2,
Line 39, change "(40)" to -- (4°) --
Line 64, (claim 3), change "(A)" to -- (Δ) --.

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*